US005664345A

United States Patent [19]

Chemello

[11] Patent Number: 5,664,345

[45] Date of Patent: Sep. 9, 1997

[54] DEVICE FOR CONTROLLING FLECTION OF A SKI BOOT UPPER

[75] Inventor: Jean-Pierre Chemello, Annecy-Le-Vieux, France

[73] Assignee: Salomon S.A., Chavanod, France

[21] Appl. No.: 370,468

[22] Filed: Jan. 9, 1995

Related U.S. Application Data

[63] Continuation of Ser. No. 66,422, May 25, 1993, abandoned.

[30] Foreign Application Priority Data

May 25, 1992 [FR] France ..... 92 06523

[51] Int. Cl.[6] ..... A43B 5/04

[52] U.S. Cl. ..... 36/118.8; 36/118.7

[58] Field of Search ..... 36/117, 118, 119, 36/120, 121, 118.7, 118.8

[56] References Cited

U.S. PATENT DOCUMENTS

| | | | |
|---|---|---|---|
| 4,381,613 | 5/1983 | Lederer | 36/118.8 |
| 4,455,768 | 6/1984 | Salomon | 36/121 |
| 4,667,424 | 5/1987 | Sartor et al. | 36/121 X |
| 4,677,771 | 7/1987 | Arieh et al. | 36/121 X |
| 4,809,448 | 3/1989 | Tonel et al. | 36/121 X |
| 4,864,745 | 9/1989 | Hensler | 36/121 X |
| 4,916,835 | 4/1990 | Begey et al. | 36/118.8 |
| 4,928,406 | 5/1990 | Montfort | 36/117 |
| 5,001,850 | 3/1991 | Mattiuzzo | 36/118.8 |
| 5,297,350 | 3/1994 | Stampaccia | 36/118.8 |

FOREIGN PATENT DOCUMENTS

| | | |
|---|---|---|
| 0 230 062 | 7/1987 | European Pat. Off. . |
| 0 234 767 | 9/1987 | European Pat. Off. . |
| 2 546 726 | 12/1984 | France . |
| 2 626 745 | 8/1989 | France . |

*Primary Examiner*—B. Dayoan

*Attorney, Agent, or Firm*—Pollock, Vande Sande & Priddy

[57] ABSTRACT

Alpine ski boot (1) comprising a shell base (2) surmounted by an upper (4) at least partially articulated (5) on the latter and at least one device (6) for back-to-front control of the active flection of the upper, constituted by a cursor transversely adjustable in position so as to delimit a rigid, movable point of support at least partially between the lower front edge (8) of the jointed upper (4) and a stationary portion (9) of the shell base (2). The cursor (7) supporting the device (6) for flection control of the upper (4) is constituted by a sliding device capable of translational travel on the guide rail (10) attached to the shell base and extending substantially parallel to at least a portion of the lower front edge (8) of the upper (4).

13 Claims, 4 Drawing Sheets

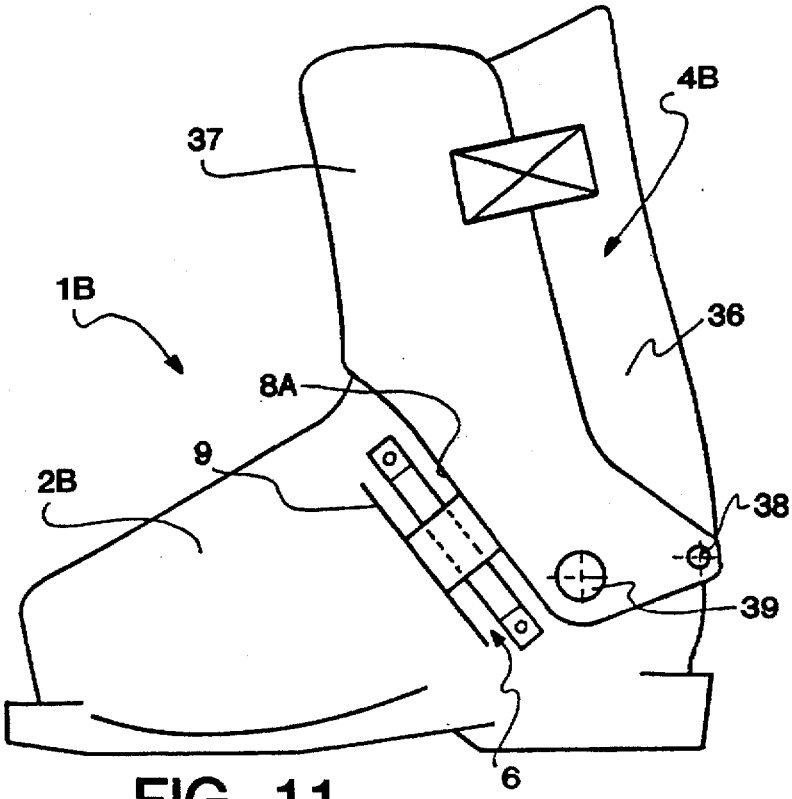
FIG. 11
FIG. 12
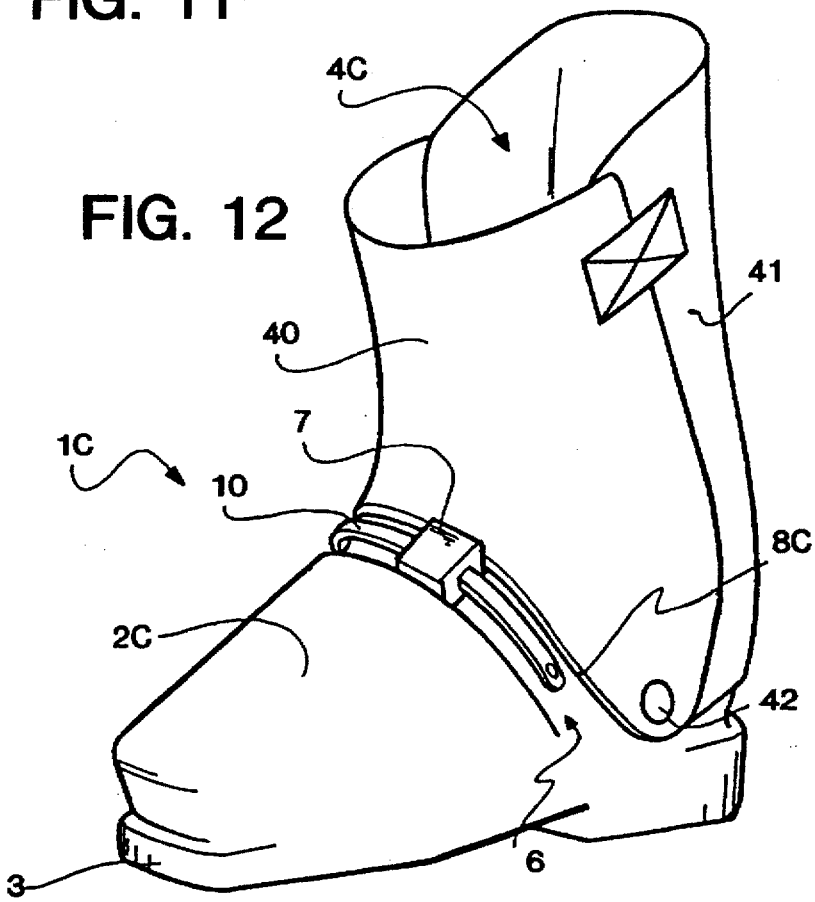

DEVICE FOR CONTROLLING FLECTION OF A SKI BOOT UPPER

This application is a continuation of application Ser. No. 08/066,422 filed May 25, 1993 now abandoned.

FIELD OF THE INVENTION

The present invention concerns an alpine ski boot comprising shall base surmounted by an upper at least partially jointed on the latter, and at least one device for back-to-front control of thee active flection of this upper. The device is constituted by a cursor whose position is adjustable transversely to the longitudinal axis of the boot, so as to delimit a rigid, movable point of support at least partially between the lower front edge of the jointed upper and a fixed portion of the shell base.

The purpose of such a flection-control device is to allow adjustment of the angle of projection of the upper in relation to the shell base, an angle which can vary around an average value, depending on the circumstances and the skier's skill level. In fact, an advanced skier works in a very flexed position, while an amateur will adopt a less pronounced angle of forward lean. The condition of the snow may also affect the position taken by the skier.

Consequently, a flection-control device gives the skier the advantage, based on personal criteria, of being able to adjust the stiffness of the articulation of the upper to the shell base, by controlling the average angle of lean.

BACKGROUND OF THE INVENTION

A device of this kind is known from French Patent No. 2 513 862, which discloses a boot whose upper is composed of a sleeve and a rear cover, the lower part of the sleeve covering the shell base and carrying approximately radially to a hinge pin in the upper, an extension which, near its end, cooperates with a support point integrally joined to the shell base and defining a flection leaf spring which works counter to variations of the angle of forward lean of the upper.

According to this same patent, the active length of the leaf can be modified by adjustment means constituted by a slide which travels in a slide track and acts as a stop motion device on the extension forming the spring leaf, for which it determines the length of active flection.

The presence of the flection leaf has the disadvantage of constituting a weak point, since it is designed to oppose resistance in a bracing arrangement under the pressure exerted by the upper, this action becoming stronger as the distance separating the point of support from the hinge pin increases.

This leads to the use of high-performance, rupture-resistant, and therefore expensive materials.

European Patent No. 0 172 159 discloses the formation of a transverse groove in the sleeve or front cover of the upper. This groove houses an elastic support element whose elastic properties can be modified in localized fashion by a rigid, movable cursor which is fastened to it and which can be moved along the elastic element in the groove in order to modify its resistance to compression.

This configuration has the disadvantage of complicating the shape of the front cover and the technique used for its construction. Moreover, because the transverse groove extends on either side of the area corresponding to the instep/flection fold, this flection-control device cannot be applied to boots whose upper opens on the front.

In addition, German Patent No. 35 30 243 discloses a flection-control device also involving the use of a rigid movable cursor whose active portion slides on the lower edge of the sleeve or front cover of the upper so as to be stopped, during flection, on a part of the shell base. The active portion of the cursor is extended by a guidance slide arranged as a stop motion device between the lower edge of the sleeve and a groove substantially parallel thereto.

In this type of construction of a flection-control device, manufacture of the shape of the front cover is relatively complex. Moreover, in the event of deterioration of the lower edge of the sleeve, the entire upper must be detached in order to repair it.

SUMMARY OF THE INVENTION

Its is an object the present invention to overcome these various difficulties, and, to this end, it concerns an alpine ski boot comprising a shell base fitted with a sole and surmounted by an upper at least partially articulated to the latter, and at least one device for back-to-front control of active flection of said upper, constituted by a cursor whose position is adjustable transversely to the longitudinal axis of the boot so as to define a movable point of support at least partially between the lower front edge of the jointed upper and a fixed portion of the shell base. That slide supporting the device for flection control of the upper is constituted by a sliding device capable of translational motion on a guide rail integrally attached to the shell base and extending substantially parallel to at least a portion of the aforementioned lower front edge of the upper.

According to another inventive feature, the sliding device is constituted by a cursor forming a frame around the guide rail, whose cross-section corresponds substantially to the interior section of the frame foxing the slide.

According to one embodiment of the invention, the guide rail is mounted on the Shell base, to which it is attached either permanently or removably to allow possible replacement. Whatever the means of attachment of the rail, this device can be designed independently of the shell base and allows easy mounting of a cursor or slide which frames the rail, i.e., which encases the transverse profile of the latter. In addition, it is thus possible to choose a material different from that used to make the shell base, either for reasons of mechanical properties (flection, sliding, wear, etc.) or for aesthetic reasons.

Still according to the invention, the stationary part of the shell base can be constituted by a projection and/or shoulder on the latter, or simply by points of attachment of the rail to the shell base. In the first type of construction, the forward movements and flective stresses of the upper are transmitted to the cursor, which, by being supported on the projection, delimits a rigid point of support. In the second type of construction, the flective stresses directed forward are transmitted to the cursor, which, since it is not locked on the opposite zone of support, tends to deform elastically the guide rail on which it is mounted. Thus, flective movements are subjected to a certain damping effect, which may prove desirable depending on the type of skier for whom the ski boot is intended.

BRIEF DESCRIPTION OF THE DRAWINGS

The invention will be better understood and other features will emerge from the following description provided with reference to the attached schematic drawings which illustrate several embodiments of the invention by way of example and in which:

FIG. 11 is a lateral view of a rear-entry boot equipped with a flection-control device according to the invention.

FIG. 12 is a lateral view of a rear-entry boot whose front and rear covers are both jointed on a single axis.

DESCRIPTION OF THE PREFERRED EMBODIMENTS

Figure 1:
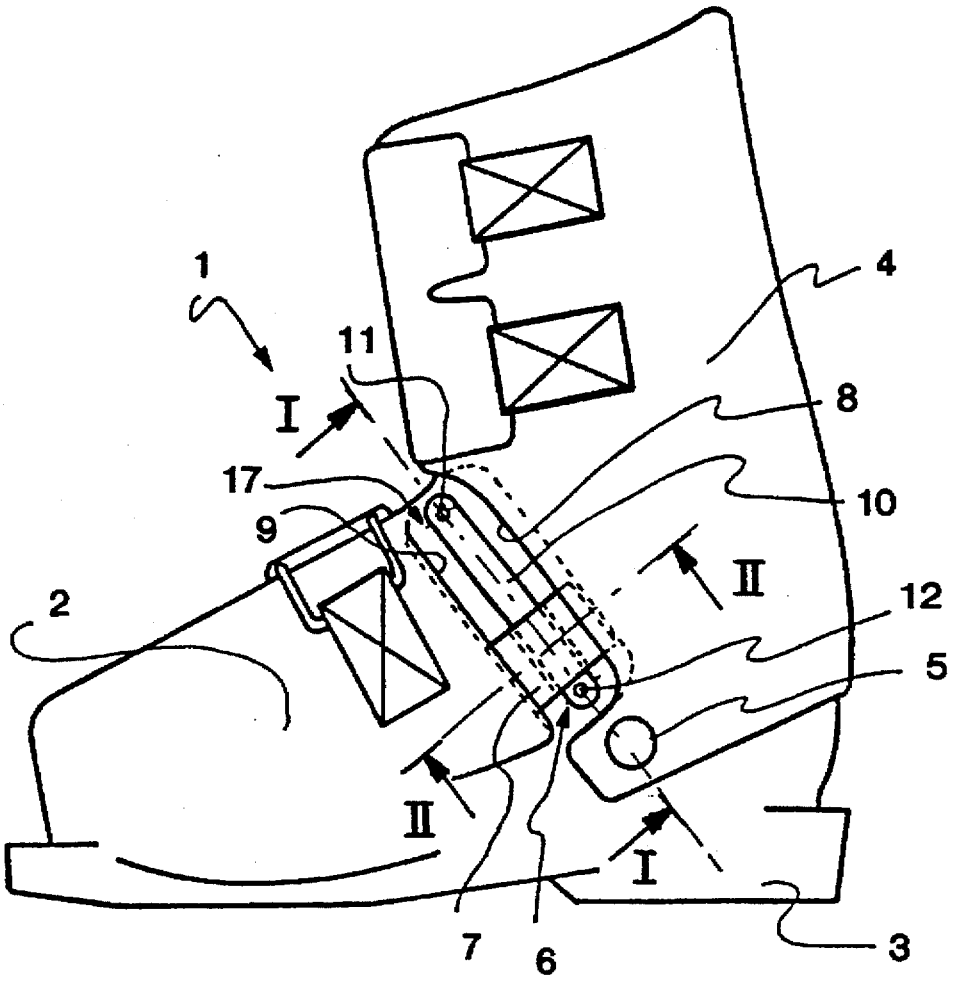
FIG. 1 is a partial lateral view of a ski boot fitted with a flection-control device according to the invention.

The boot 1 shown in FIG. 1 comprises a shell base 2 fitted with a sole 3 and surmounted by an upper 4 at least partially jointed by means of a jointing rivet 5 positioned on the shell base 2.

The boot 1 further comprises a device 6 for back-to front control of the active flection of the upper 4.

The flection-control slide device 6 is constituted by a cursor 7 transversely adjustable in position in order to delimit, at least partially, a rigid, movable point of support between the lower front edge 8 of the movable upper 4 and a stationary portion 9 of the shell base 2.

In the present instance, the cursor 7 belonging to the device 6 for flection control of the upper 4 is constituted by a sliding device capable of travel in translational motion on a guide rail 10 fastened to the shell base 4 and extending substantially parallel to at least one portion of the lower front edge 8 of the upper 4.

More specifically, the slide device forms a framework enclosing the guide rail 10, whose section corresponds substantially to the interior section of the frame formed in the aforementioned slide device.

Figure 3:
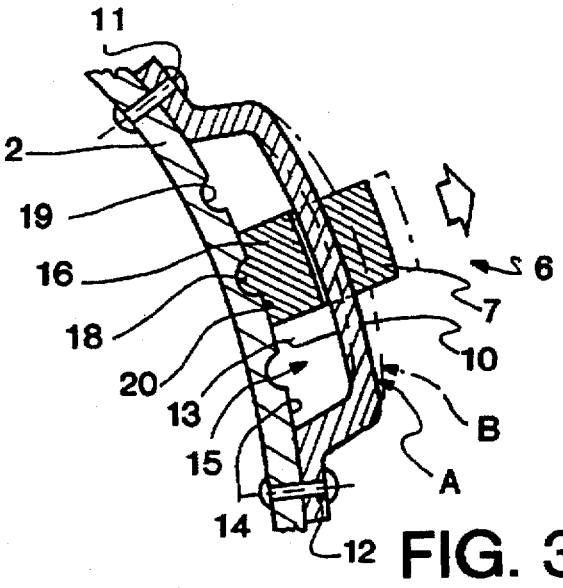
FIG. 3 is a view in longitudinal cross-section of the flection-control device along line I—I in FIG. 1, according to a first variant.

According to the present example, which constitutes a variant of the invention made especially explicit in FIG. 3, the rail 10 has a rectangular section and is connected at its two ends 11 and 12 at the shell base 2.

The rail 10 forms a bridge, thus delimiting, between its lower face 13 facing the shell base 2 and a corresponding surface 14 of the rail, positioned opposite this face, a sliding space 15 extending upward and reserved for the lower portion 16 of the slide 7.

Figure 2:
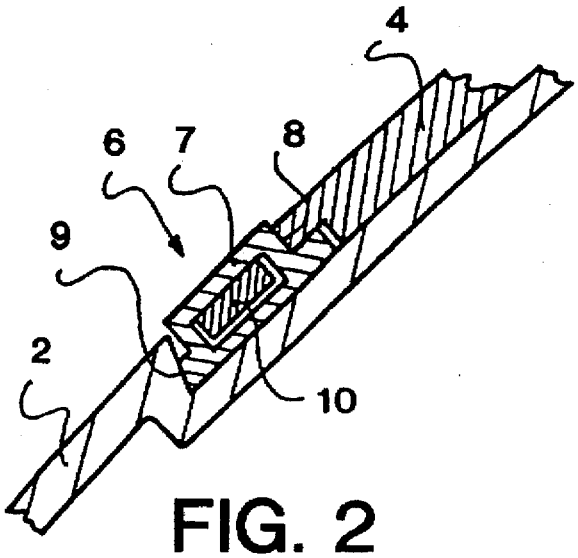
FIG. 2 is a cross-section along line II—II in FIG. 1.

As shown in FIGS. 1 and 2, the stationary part 9 of the shell base 2 is constituted by an elongated projection extending substantially parallel to the guide rail 10 and to the lower edge 8 of the front part of the upper 4, so as to delimit, between the latter and the projection 9 on the shell base 2 a slideway 17, extending width-wise, for the cursor 7 thus interposed between the upper 3 and the shell base 2. Moreover, the projection 9 also forms a stop opposing the cursor 7 during back-to-front flection of the upper 4.

According to another inventive feature, the cursor 7 comprises means for position indexing along the guide rail 10, using elastic means associated with a boss 18 cooperating with notches 19 constituting these indexing means.

Still according to the first embodiment, shown in FIG. 3, the boss 18 is provided on the lower face 20 of the cursor 7 turned toward the shell base 2, and cooperates with one of the notches 19 provided on the shell base 2 along a line corresponding to the translational travel of this slide 7.

Figure 4:
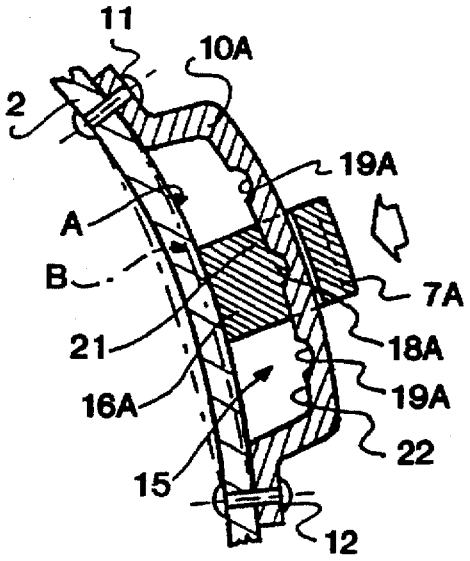
FIG. 4 is a view in longitudinal cross-section of the flection-control device along line I—I in FIG. 1, according to a second variant.

A second embodiment, shown in FIG. 4, differs from the preceding one in that the boss 18A is provided on the inner face 21 of the slide frame 7A and cooperates with one of the notches 19A provided on a corresponding face 22 of the rail 10A opposite this inner face 21 of the frame.

As shown in FIG. 4, the boss 18A is provided on a lower inner longitudinal face 21 of the frame, the notches 19A being provided on lower face 22 of the rail facing the shell base 2.

In a reverse arrangement, the boss can be provided on an upper, not lower, inner longitudinal face of the frame. In this case (not illustrated), the notches are provided on an upper, external face of the rail.

In either case, the elastic means associated with the indexing means, i.e., the boss 18, 18A and the notches 19, 19A, are formed by the capacity of the guide rail 10, 10A to undergo upward elastic deformation between its two ends 11, 12.

To illustrate this deformation, FIGS. 3 and 4 show the rails 10 or 10A in position A, termed the rest position (solid lines), and in position B, termed the working position (broken lines).

Figure 5:
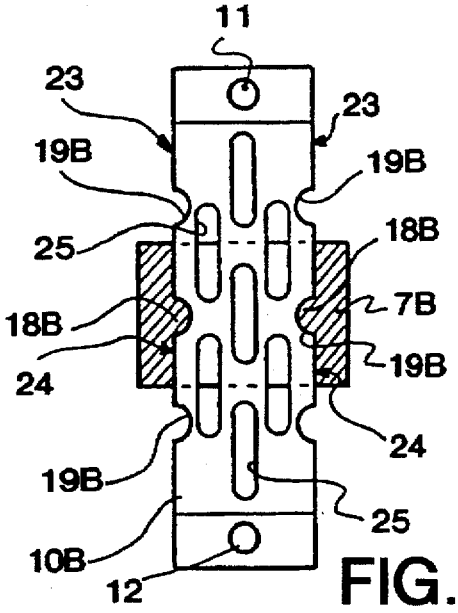
FIG. 5 is a top view in partial cross-section of a flection-control device according to a third variant.
Figure 6:
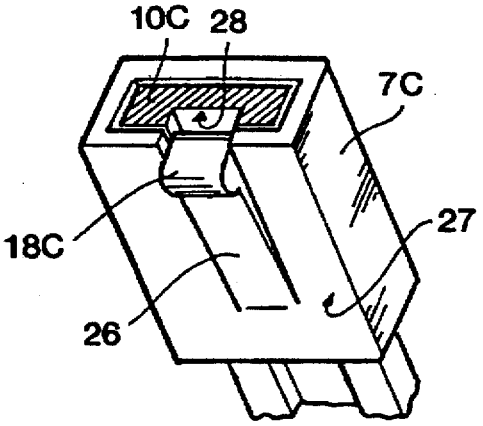
FIG. 6 is a perspective view of a flection-control device according to a fourth variant.

According to a third variant, illustrated in FIG. 5, the device comprises two bosses 18B arranged symmetrically on each inner lateral face 24 of the slide frame 7B, and cooperating with corresponding lateral notches 19B produced on the edges 23 of the rail 10B.

In this case, the elastic means associated with the indexing means, i.e., the bosses 18B and notches 19B, are constituted by the capacity of the rail 10B to undergo lateral deformation under compression, a capability engendered by the presence of slots 25 produced longitudinally on the rail 10B at right angles to the lateral notches 19B and to its edges 23.

Figure 7:
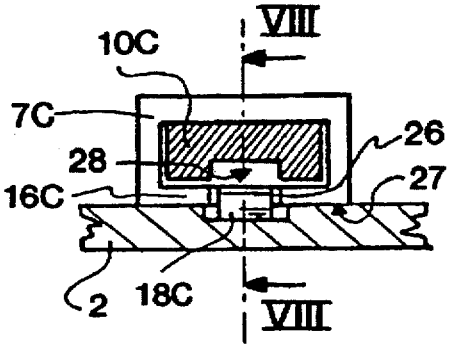
FIG. 7 is a view in transverse cross-section of a flection-control device according to FIG. 6.
Figure 8:
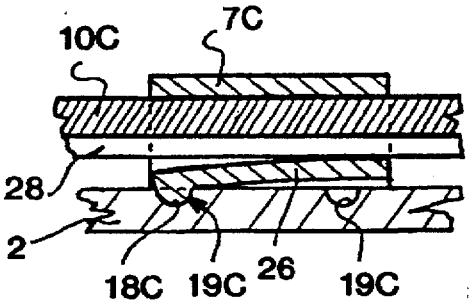
FIG. 8 is a view in longitudinal cross-section along line VIII—VIII in FIG. 7.
Figure 9:
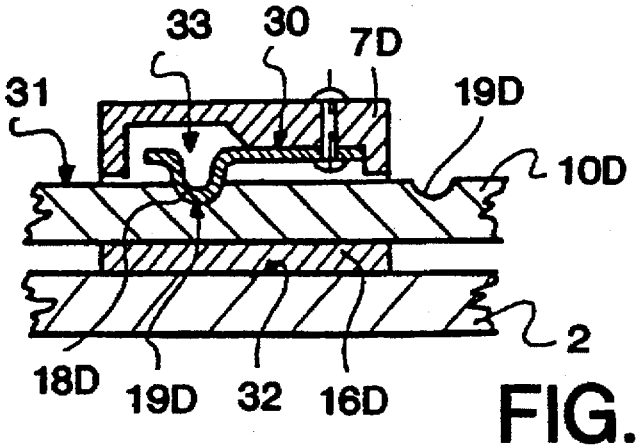
FIG. 9 is a view in longitudinal cross-section of a flection-control device according to a fifth variant.

According to a fourth variant, shown in FIGS. 7, 8, and 9, the means for indexing the cursor or slide 7C comprise an elastic tongue 26 produced by cutting out partially the lower wall 27 of the slide 7C and comprising, at its free end facing the shell base 2, a boss 18C cooperating with notches 19C in shell base 2.

Moreover, the rail 10C comprises a longitudinal incision 28 made on its surface facing the tongue 26, so as to allow clearance of the tongue during movement from one notch 19C to another.

According to a fifth embodiment, illustrated in FIG. 9, the means for indexing the cursor or slide 7D are constituted by an elastic tongue 29 mounted on an inner longitudinal wall 30 of the slide 7D and incorporating, at one free end, a boss 18D capable of cooperating with notches 19D in the upper face 31 of guide fall 10D.

The inner recess 32 formed by the slide 7D comprises a space 33 allowing clearance of the elastic tongue.

Whatever the variant implemented, the invention suggests the manufacture of a single flection-control device extending into the front zone of the shell base 2, between the latter and the lower edge 8 of the front portion of the upper 4.

In addition, the boot in question may incorporate a flection-control device according to the invention on at least one of its sides.

The invention is applicable to all types of boots.

Figure 10:
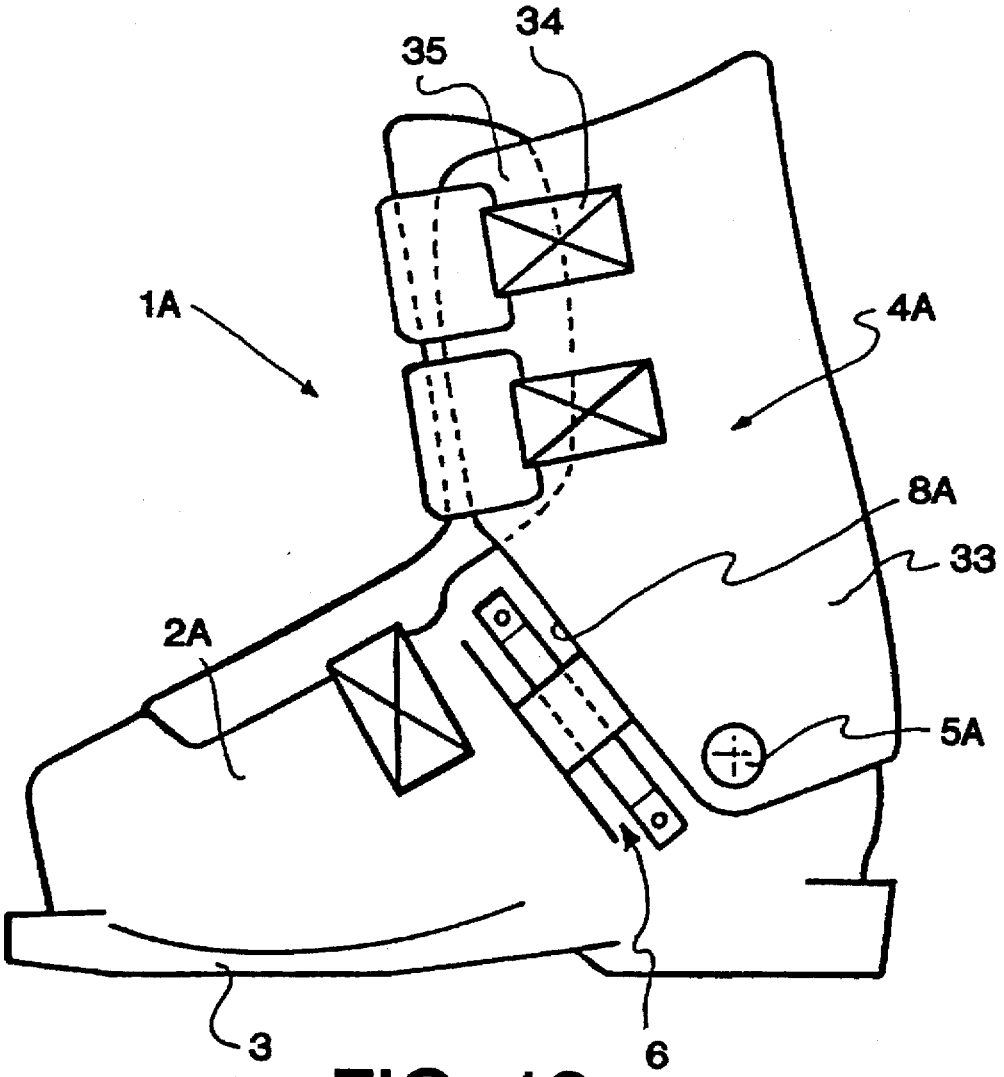
FIG. 10 is a lateral view of a boot incorporating a central and/or front opening equipped with a flection control device according to the invention.

As an example, shown in FIG. 10, the upper 4A of the boot 1A has a collar 33 articulated at 5A to the shell base 2A, the front upper part 35 of the collar being fitted with means 34 for closing the collar over the skier's lower leg, while the front lower part cooperates with at least one flection-control device 6 by means of its lower edge 8A.

In the example illustrated in FIG. 11, the upper 4B of the boot 1B has at least two parts, a rear cover 36 and a front cover 37, the latter cooperating with the cursor belonging to the flection-control device 6 by means of at least one portion of its lower front edge 8B.

In this case, the front and rear covers 37 and 36 are mutually articulated by a free joint 38, the entire unit being articulated around the joint 39 attached to the shell base 2B and to which the front cover 37 is connected.

In a different configuration, the boot 1C shown in FIG. 12 comprises an upper 4C constituted by a front cover 40 and a rear cover 41 articulated on a single pin 42 attached to the shell base. In this example, the guide rail 10 extends from the outer to the inner side of the boot and is fitted with a single cursor 7.

The invention is not limited to a boot whose shell base is fitted with a projection 9 designed for support of the slide 7 when the upper 4, 4A, 4B, 4C is stressed forward under flection; it also encompasses boots whose shells bases are not fitted with a support zone of this type. The stationary portion 9 of the shell base 2 is then constituted by points of attachment of the rail 10 to the shell base, such as points 11 and 12 of the rail in FIG. 1. In this case, the guide rail 10 can advantageously be made flexible and/or elastically deformable so as to perform a damping function. To this end, several types of guide rails 10 of greater or lesser stiffness can be provided, thus varying the damping properties of the boot by means of the device 6.

In the case of a device 6 incorporating a guide rail, as described in FIG. 12, two cursor 7 can also be mounted while remaining within the scope of the invention.

What is claimed is:

1. An alpine ski boot comprising a shell base surmounted by an upper at least partially articulated to said shell base, and a device independent of said shell base for back-to front control of active flection of said upper, said device being constituted by a guide rail having two ends attached to said shell base and extending substantially parallel to at least a portion of said lower front edge of said upper, and a cursor which can be adjusted in position transversely to a longitudinal axis of said boot so as to delimit a movable point of support at least partially between a lower front edge of said jointed upper and a stationary portion of said shell base, said cursor being constituted by a sliding element capable of translational movement on said guide rail, said cursor forming a frame enclosing said guide rail and having a section which corresponds substantially to an interior section of said frame formed inside said cursor.

2. A ski boot according to claim 1, wherein said guide rail forms a bridge so as to create, between a lower face of said guide rail turned toward said shell base and a corresponding surface of said shell base positioned opposite said lower face, an upwardly extending space in which a lower portion of said cursor can slide.

3. A ski boot according to claim 2, wherein said stationary portion of said shell base is constituted by an elongated projection extending substantially parallel to said guide rail and to said lower edge of a front part of said upper, so as to delimit between said upper and said projection of said shell base a slideway extending width-wise for said cursor thus interposed between said upper and said shell base, and a stop opposing a motion of said cursor during back-to-front flection of said upper.

4. A ski boot according to claim 3, wherein said cursor comprises an elastic mechanism associated with a boss on one of said cursors and said frame cooperating with notches provided on one of said shell base and said guide rail and constituting said indexing means.

5. A ski boot according to claim 4, wherein said boss is provided on the lower face of said cursor racing said shell base said boss cooperating with one of said notches provided on said shell base along a line corresponding to translational travel of said cursor.

6. A ski boot according to claim 4, wherein said boss is provided on an interior face of said frame of said cursor, said boss cooperating with one of said notches provided on a corresponding face of said guide rail positioned opposite said interior face of said frame.

7. A ski boot according to claim 6, wherein said boss is provided on a lower interior longitudinal face of said frame and said notches are provided on a lower face of said guide rail opposite said shell base.

8. A ski boot according to claim 6, wherein said boss is provided on an upper interior longitudinal face of said frame and said notches are provided on an upper external face of said guide rail.

9. A ski boot according to claim 8, wherein said elastic mechanism associated with said indexing means is constituted by elastic deformability of said guide rail elastically deformed upward between said two ends of said guide rail.

10. A ski boot according to claim 4, wherein said boss is provided on at least one interior lateral face of said frame of said cursor and said notches are provided on at least one corresponding edge of said guide rail.

11. A ski boot according to claim 4, wherein said elastic mechanism is constituted by lateral deformablity of said guide rail under compression, said deformablity being provided by slots disposed longitudinally on said rail at right angles to edges of said guide rail.

12. A ski boot according to claim 4, wherein said elastic mechanism is constituted by an elastic tongue obtained by partially cutting out a lower wall of said cursor and comprising, at a free end of said tongue facing said shell base, a boss cooperating with notches in said shell base.

13. A ski boot according to claim 4, wherein said means of indexing said cursor are constituted by an elastic tongue mounted on an interior longitudinal wall of said cursor and comprising, at a free end of said tongue, a boss cooperating with notches disposed in an upper face of said guide rail.

* * * * *